US012089647B2

(12) United States Patent
Potter

(10) Patent No.: US 12,089,647 B2
(45) Date of Patent: Sep. 17, 2024

(54) VAPOR PROVISION SYSTEMS HAVING A FLAVOR IMPARTING REGION

(71) Applicant: Nicoventures Trading Limited, London (GB)

(72) Inventor: Mark Potter, London (GB)

(73) Assignee: NICOVENTURES TRADING LIMITED, London (GB)

( * ) Notice: Subject to any disclaimer, the term of this patent is extended or adjusted under 35 U.S.C. 154(b) by 498 days.

(21) Appl. No.: 17/310,481

(22) PCT Filed: Feb. 5, 2020

(86) PCT No.: PCT/GB2020/050257

§ 371 (c)(1),
(2) Date: Aug. 5, 2021

(87) PCT Pub. No.: WO2020/161489

PCT Pub. Date: Aug. 13, 2020

(65) Prior Publication Data

US 2022/0125117 A1 Apr. 28, 2022

(30) Foreign Application Priority Data

Feb. 6, 2019 (GB) ..... 1901652

(51) Int. Cl.
*A24F 40/485* (2020.01)
*A24F 40/46* (2020.01)

(52) U.S. Cl.
CPC ..... *A24F 40/485* (2020.01); *A24F 40/46* (2020.01)

(58) Field of Classification Search
CPC ..... A24F 40/485; A24F 40/46; A24F 40/40; A24F 40/10
See application file for complete search history.

(56) References Cited

U.S. PATENT DOCUMENTS 10,433,580 B2 * 10/2019 Kobal ..... A24B 15/167
11,672,276 B2 * 6/2023 Yilmaz ..... A24F 40/30 131/329
2016/0120224 A1 5/2016 Mishra et al.
(Continued)

FOREIGN PATENT DOCUMENTS

CA 3042128 A1 5/2018
JP 2013521818 A 6/2013
JP 2019522963 A 8/2019
(Continued)

OTHER PUBLICATIONS

International Search Report and Written Opinion, International Application No. PCT/GB2020/050257, mailing date Apr. 22, 2020, 15 pages.
(Continued)

*Primary Examiner* — Hae Moon Hyeon
(74) *Attorney, Agent, or Firm* — Husch Blackwell

(57) ABSTRACT

An aerosol provision system comprising an air path extending from a vapor generating region in which vapor is generated for user inhalation to a flavor imparting region for receiving a flavor imparting medium for imparting a flavor to the vapor; wherein a first cross-sectional area of the air path in the vapor generating region is smaller than a second cross-sectional area of the air path where the air path enters the flavor imparting region.

14 Claims, 4 Drawing Sheets

(56) References Cited

U.S. PATENT DOCUMENTS

| | | | | |
|---|---|---|---|---|
| 2017/0319799 | A1* | 11/2017 | Yamada | H05B 1/0297 |
| 2019/0320718 | A1* | 10/2019 | Yilmaz | A24B 15/167 |

FOREIGN PATENT DOCUMENTS

| | | | |
|---|---|---|---|
| JP | 2019533454 | A | 11/2019 |
| KR | 20180114194 | A | 10/2018 |
| KR | 20190006540 | A | 1/2019 |
| KR | 20190027903 | A | 3/2019 |
| RU | 2509516 | C2 | 3/2014 |
| RU | 2670039 | C2 | 10/2018 |
| WO | WO 2011/117580 | A2 | 9/2011 |
| WO | 2017216516 | A1 | 12/2017 |
| WO | 2018086999 | A1 | 5/2018 |
| WO | WO 2018/083037 | A1 | 5/2018 |

OTHER PUBLICATIONS

"International Preliminary Report on Patentability received for PCT Patent Application No. PCT/GB2020/050257, mailed on Aug. 19, 2021", 8 pages.

"Notice of Allowance received for Korean Patent Application No. 10-2021-7024642, mailed on May 19, 2023", 4 pages (2 pages of English Translation and 2 pages of Official Copy).

"Office Action received for Russian Patent Application No. 2021122525, mailed on Mar. 30, 2022", 2 pages.

* cited by examiner

VAPOR PROVISION SYSTEMS HAVING A FLAVOR IMPARTING REGION

PRIORITY CLAIM

The present application is a National Phase entry of PCT Application No. PCT/GB2020/050257, filed Feb. 5, 2020, which claims priority from Great Britain Application No. 1901652.6, filed Feb. 6, 2019, each of which is hereby fully incorporated herein by reference.

TECHNICAL FIELD

The present disclosure relates to vapor provision systems such as nicotine delivery systems (e.g. electronic cigarettes and the like).

BACKGROUND

Electronic vapor provision systems such as electronic cigarettes (e-cigarettes) generally contain a vapor precursor material, such as a reservoir of a source liquid containing a formulation, typically including nicotine, or a solid material such as a tobacco-based product, from which a vapor is generated for inhalation by a user, for example through heat vaporization. Thus, a vapor provision system will typically comprise a vapor generation chamber containing a vaporizer, e.g. a heating element, arranged to vaporize a portion of precursor material to generate a vapor in the vapor generation chamber. As a user inhales on the device and electrical power is supplied to the vaporizer, air is drawn into the device through inlet holes and into the vapor generation chamber where the air mixes with the vaporized precursor material and forms a condensation aerosol. There is a flow path between the vapor generation chamber and an opening in the mouthpiece so the incoming air drawn through the vapor generation chamber continues along the flow path to the mouthpiece opening, carrying some of the vapor/condensation aerosol with it, and out through the mouthpiece opening for inhalation by the user. Some electronic cigarettes may also include a flavor element in the flow path through the device to impart additional flavors. Such devices may sometimes be referred to as hybrid devices and the flavor element may, for example, include a portion of tobacco arranged in the air path between the vapor generation chamber and the mouthpiece so that vapor/condensation aerosol drawn through the devices passes through the portion of tobacco before exiting the mouthpiece for user inhalation.

Various approaches are described herein which seek to provide improved performance of the device while helping address or mitigate some of the issues discussed above.

SUMMARY

According to a first aspect of certain embodiments there is provided an aerosol provision system comprising an air path extending from a vapor generating region in which vapor is generated for user inhalation to a flavor imparting region for receiving a flavor imparting medium for imparting a flavor to the vapor; wherein a first cross-sectional area of the air path in the vapor generating region is smaller than a second cross-sectional area of the air path where it enters the flavor imparting region.

According to another aspect of certain embodiments there is provided an aerosol provision system comprising a flavor imparting medium, the aerosol provision system in accordance with the first aspect summarized above.

According to another aspect of certain embodiments there is provided an aerosol provision system comprising a flavor imparting medium, the aerosol provision system in accordance with the first aspect summarized above.

According to another aspect of certain embodiments there is provided aerosol provision means comprising air path means extending from a vapor generating region in which vapor is generated for user inhalation to a flavor imparting region for receiving a flavor imparting means for imparting a flavor to the vapor; wherein a first cross-sectional area of the air path means in the vapor generating region is smaller than a second cross-sectional area of the air path means where it enters the flavor imparting region.

According to another aspect of certain embodiments there is provided a cartridge for an aerosol provision system, the cartridge comprising an air path extending from a vapor generating region in which vapor is generated for user inhalation to a flavor imparting region for receiving a flavor imparting medium for imparting a flavor to the vapor; wherein a first cross-sectional area of the air path in the vapor generating region is smaller than a second cross-sectional area of the air path where it enters the flavor imparting region.

It will be appreciated that features and aspects of the disclosure described above in relation to the first and other aspects of the disclosure are equally applicable to, and may be combined with, embodiments of the disclosure according to other aspects of the disclosure as appropriate, and not just in the specific combinations described above.

BRIEF DESCRIPTION OF THE DRAWINGS

Embodiments of the invention will now be described, by way of example only, with reference to the accompanying drawings, in which.

DETAILED DESCRIPTION OF THE DRAWINGS

Figure 1:
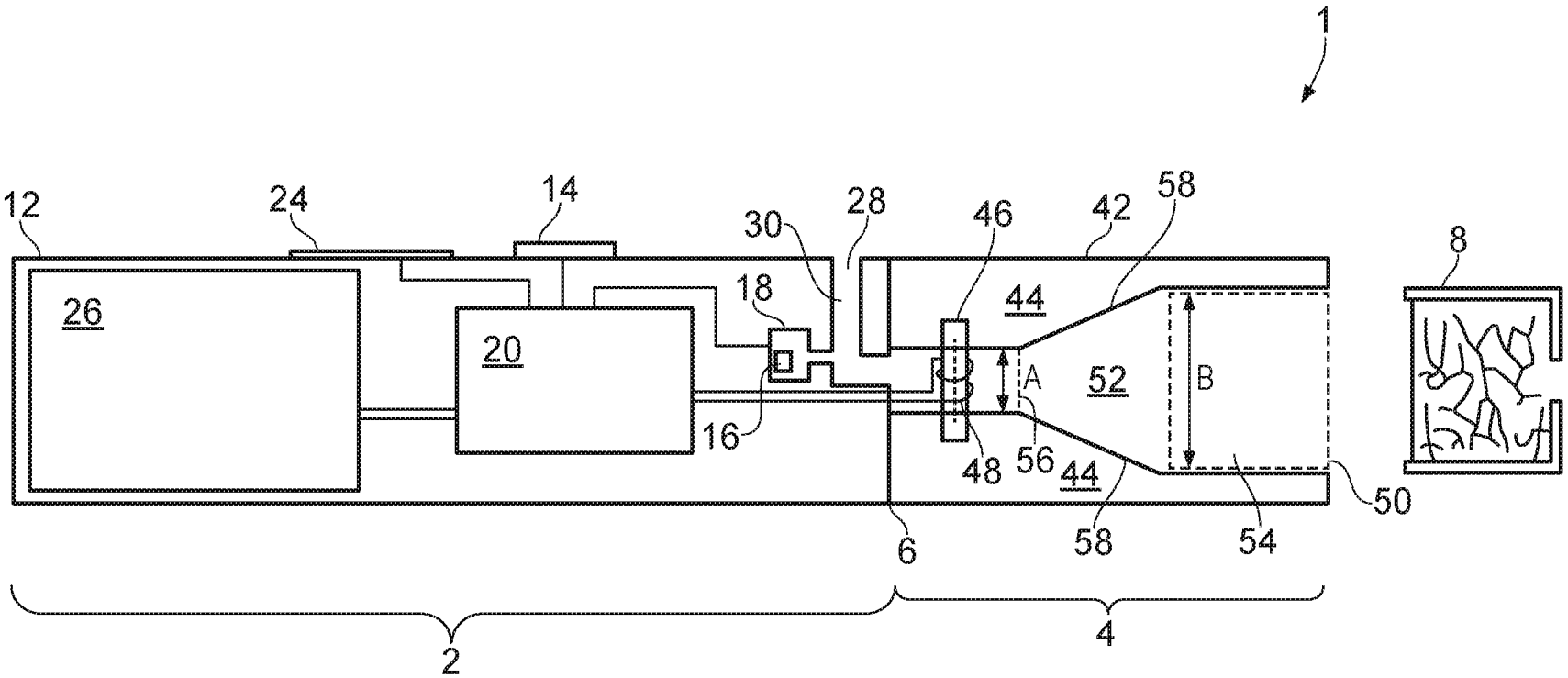
FIG. 1 represents in highly schematic cross-sectional area A vapor provision system in accordance with certain embodiments of the disclosure.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to vapor provision systems, which may also be referred to as aerosol provision systems, such as e-cigarettes, including hybrid devices. Throughout the following description the term "e-cigarette" or "electronic cigarette" may sometimes be used, but it will be appreciated this term may be used interchangeably with vapor provision system/device and electronic vapor provision system/device. Furthermore, and as is common in the technical field, the terms "vapor" and "aerosol", and related terms such as "vaporize", "volatilize" and "aerosolize", may generally be used interchangeably.

Vapor provision systems (e-cigarettes) often, though not always, comprise a modular assembly including both a reusable part and a replaceable (disposable) cartridge part. Often the replaceable cartridge part will comprise the vapor precursor material and the vaporizer and the reusable part will comprise the power supply (e.g. rechargeable battery), activation mechanism (e.g. button or puff sensor), and control circuitry. However, it will be appreciated these different parts may also comprise further elements depending on functionality. For example, for a hybrid device the cartridge part may also comprise the additional flavor element or flavor imparting medium, e.g. a portion of tobacco. In such cases the flavor element insert may itself be removable from the disposable cartridge part so it can be replaced separately from the cartridge, for example to change flavor or because the usable lifetime of the flavor element insert is less than the usable lifetime of the vapor generating components of the cartridge. In some examples the flavor element insert may be contained within a pod, container or further cartridge. In some examples, the pod may be reusable and a user may be able to access flavor element insert within the pod to replace the flavor element insert. In other examples, the pod may be disposable and a user is discouraged from accessing or attempting to replace the flavor element insert. Use of a pod may provide an enhanced user experience by, for example, ensuring optimal positioning of the flavor element insert within an airflow path and/or by restricting the properties of the flavor element insert (e.g. volume, consistency, density etc.).

The reusable device part will often also comprise additional components, such as a user interface for receiving user input and displaying operating status characteristics.

For modular devices a cartridge and control unit are electrically and mechanically coupled together for use, for example using a screw thread, latching or bayonet fixing with appropriately engaging electrical contacts. When the vapor precursor material in a cartridge is exhausted, or the user wishes to switch to a different cartridge having a different vapor precursor material, a cartridge may be removed from the control unit and a replacement cartridge attached in its place. Devices conforming to this type of two-part modular configuration may generally be referred to as two-part devices or multi-part devices.

It is relatively common for electronic cigarettes, including multi-part devices, to have a generally elongate shape and, for the sake of providing a concrete example, certain embodiments of the disclosure described herein will be taken to comprise a generally elongate multi-part device employing disposable cartridges with a tobacco pod insert. However, it will be appreciated the underlying principles described herein may equally be adopted for different electronic cigarette configurations, for example single-part devices or modular devices comprising more than two parts, refillable devices and single-use disposable devices, as well as devices conforming to other overall shapes, for example based on so-called box-mod high performance devices that typically have a more box-like shape. More generally, it will be appreciated certain embodiments of the disclosure are based on electronic cigarettes that are configured to provide activation functionality in accordance with the principles described herein, and the specific constructional aspects of electronic cigarette configured to provide the described activation functionality are not of primary significance.

FIG. 1 is a cross-sectional view through an example vapor provision system/e-cigarette 1 in accordance with certain embodiments of the disclosure. The e-cigarette 1 comprises two main components, namely a reusable part 2 and a replaceable/disposable cartridge part 4. In this specific example the e-cigarette 1 is assumed to be a multi-part hybrid device with the cartridge part 4 including a removable insert or flavor imparting means 8 containing a portion of tobacco (for example shredded, reconstituted or extruded tobacco) provided within an insert housing. However, the fact this example is a multi-part hybrid device is not in itself directly significant to the device activation functionality as described further herein.

In normal use the reusable part 2 and the cartridge part 4 are releasably coupled together at an interface 6. When the cartridge part is exhausted or the user simply wishes to switch to a different cartridge part, the cartridge part may be removed from the reusable part and a replacement cartridge part attached to the reusable part in its place. The interface 6 provides a structural, electrical and air path connection between the two parts and may be established in accordance with conventional techniques, for example based around a screw thread, latch mechanism, or bayonet fixing with appropriately arranged electrical contacts and openings for establishing the electrical connection and air path between the two parts as appropriate. The specific manner by which the cartridge part 4 mechanically mounts to the reusable part 2 is not significant to the principles described herein, but for the sake of a concrete example is assumed here to comprise a latching mechanism, for example with a portion of the cartridge being received in a corresponding receptacle in the reusable part with cooperating latch engaging elements (not represented in FIG. 1). It will also be appreciated the interface 6 in some implementations may not support an electrical connection between the respective parts. For example, in some implementations a vaporizer may be provided by the reusable part rather than in the cartridge part, or the transfer of electrical power from the reusable part to the cartridge part may be wireless (e.g. based on electromagnetic induction), so that an electrical connection between the reusable part and the cartridge part is not needed.

The cartridge part 4 may in accordance with certain embodiments of the disclosure be broadly conventional. In FIG. 1, the cartridge part 4 comprises a cartridge housing 42 formed of a plastics material. The cartridge housing 42 supports other components of the cartridge part and provides the mechanical interface 6 with the reusable part 2. The cartridge housing is generally circularly symmetric about a longitudinal axis along which the cartridge part couples to the reusable part 2. In this example the cartridge part has a length of around 4 cm and a diameter of around 3 cm. However, it will be appreciated the specific geometry, and more generally the overall shapes and materials used, may be different in different implementations.

Within the cartridge housing 42 is a reservoir 44 that contains liquid vapor precursor material. The liquid vapor precursor material may be conventional, and may be referred to as e-liquid. The liquid reservoir 44 in this example has an annular shape with an outer wall defined by the cartridge housing 42 and an inner wall 58 that defines an air path 52 through the cartridge part 4. The reservoir 44 is closed at each end with end walls to contain the e-liquid. The reservoir 44 may be formed in accordance with conventional techniques, for example it may comprise a plastics material and be integrally molded with the cartridge housing 42.

The flavor insert or flavor imparting means (e.g. a tobacco pod or container) 8 in this example is inserted into an open end of air path 52 opposite to the end of the cartridge 4 which couples to the control unit 2. The region of the cartridge air path 52 into which the flavor insert 8 is inserted in effect defines a flavor insert region 54 for the cartridge part. In these and other examples, the retention and positioning of the flavor insert 8 may be due to friction and/or may be facilitated by clips, ledges and other features within the air path 52. In some examples the flavor insert 8 may be further retained by attaching a mouthpiece element downstream of the flavor insert 8. Such a mouthpiece element would include an opening at each end to allow air drawn along the air path 52 during use.

In the example shown, the flavor insert 8 includes a housing which houses or retains a flavorant. The housing for the flavor insert 8 also includes an opening at each end to allow air drawn along the air path 52 during use to pass through the flavor insert 8 and so pick up flavors from the flavorant within (tobacco in this example) before exiting the cartridge 4 though a mouthpiece outlet 50 for user inhalation. In some examples, the housing of the flavor insert 8 may define or otherwise incorporate a mouthpiece element. In other examples the flavor element insert may not include housing. In these examples it may comprise a flavorant, which may or may not be wrapped or coated in an aerosol permeable wrap or layer.

The cartridge part further comprises a wick 46 and a heater (vaporizer) 48 located towards an end of the reservoir 44 opposite to the mouthpiece outlet 50. In this example the wick 46 extends transversely across the cartridge air path 52 with its ends extending into the reservoir 44 of e-liquid through openings in the inner wall of the reservoir 44. The openings in the inner wall of the reservoir 44 are sized to broadly match the dimensions of the wick 46 to provide a reasonable seal against leakage from the liquid reservoir into the cartridge air path without unduly compressing the wick, which may be detrimental to its fluid transfer performance.

The wick 46 and heater 48 are arranged in the cartridge air path 52 such that a region of the cartridge air path 52 around the wick 46 and heater 48 in effect defines a vapor generating region or vaporization region 56 for the cartridge part. The E-liquid in the reservoir 44 infiltrates the wick 46 through the ends of the wick extending into the reservoir 44 and is drawn along the wick by surface tension/capillary action (i.e. wicking). The heater 48 in this example comprises an electrically resistive wire coiled around the wick 46. In this example the heater 48 comprises a nickel chrome alloy (Cr20Ni80) wire and the wick 46 comprises a glass fiber bundle, but it will be appreciated the specific vaporizer configuration is not significant to the principles described herein. In use electrical power may be supplied to the heater 48 to vaporize an amount of e-liquid (vapor precursor material) drawn to the vicinity of the heater 48 by the wick 46. Vaporized e-liquid may then become entrained in air drawn along the cartridge air path from the vaporization region through the flavor element insert 8 and out the mouthpiece outlet 50 for user inhalation.

The rate at which e-liquid is vaporized by the vaporizer (heater) 48 will depend on the amount (level) of power supplied to the heater 48 during use. Thus electrical power can be applied to the heater to selectively generate vapor from the e-liquid in the cartridge part 4, and furthermore, the rate of vapor generation can be changed by changing the amount of power supplied to the heater 48, for example through pulse width and/or frequency modulation techniques.

The reusable part 2 comprises an outer housing 12 with an opening that defines an air inlet 28 for the e-cigarette, a battery 26 for providing operating power for the electronic cigarette, control circuitry 20 for controlling and monitoring the operation of the electronic cigarette, a user input button 14, an inhalation sensor (puff detector) 16, which in this example comprises a pressure sensor located in a pressure sensor chamber 18, and a visual display 24.

The outer housing 12 may be formed, for example, from a plastics or metallic material and in this example has a circular cross-sectional area generally conforming to the shape and size of the cartridge part 4 so as to provide a smooth transition between the two parts at the interface 6. In this example, the reusable part has a length of around 6 cm so the overall length of the e-cigarette when the cartridge part and reusable part are coupled together is around 10 cm. However and as already noted, it will be appreciated that the overall shape and scale of an electronic cigarette implementing an embodiment of the disclosure is not significant to the principles described herein.

The air inlet 28 connects to an air path 30 through the reusable part 2. The air path 30 of the reusable part 2 in turn connects to the cartridge air path 52 across the interface 6 when the reusable part 2 and cartridge part 4 are connected together. The pressure sensor chamber 18 containing the pressure sensor 16 is in fluid communication with the air path 30 in the reusable part 2 (i.e. the pressure sensor chamber 18 branches off from the air path 30 in the reusable part 2). Thus, when a user inhales on the mouthpiece opening 50, there is a drop in pressure in the pressure sensor chamber 18 that may be detected by the pressure sensor 16 and also air is drawn in through the air inlet 28, along the air path 30 of the reusable part 2, across the interface 6, through the vapor generation region in the vicinity of the heater 48 (where vaporized e-liquid becomes entrained in the air flow when the vaporizer is active), along the cartridge air path 52, and out through the mouthpiece opening 50 for user inhalation.

The battery 26 in this example is rechargeable and may be of a conventional type, for example of the kind normally used in electronic cigarettes and other applications requiring provision of relatively high currents over relatively short periods. The battery 26 may be recharged through a charging connector in the reusable part housing 12, for example a Universal Serial Bus (USB) connector.

The user input button 14 in this example is a conventional mechanical button, for example comprising a spring mounted component which may be pressed by a user to establish an electrical contact. In this regard, the input button may be considered to provide a manual input mechanism for the terminal device, but the specific manner in which the button is implemented is not significant. For example, different forms of mechanical button or touch-sensitive button (e.g. based on capacitive or optical sensing techniques) may be used in other implementations. The specific manner in which the button is implemented may, for example, be selected having regard to a desired aesthetic appearance.

The display 24 is provided to give a user with a visual indication of various characteristics associated with the electronic cigarette, for example current power setting information, remaining battery power, and so forth. The display may be implemented in various ways. In this example the display 24 comprises a conventional pixilated Liquid Crystal Display (LCD) screen that may be driven to display the desired information in accordance with conventional techniques. In other implementations the display may comprise one or more discrete indicators, for example Light Emitting Diodes (LEDs), that are arranged to display the desired information, for example through particular colors and/or flash sequences. More generally, the manner in which the display is provided and information is displayed to a user using the display is not significant to the principles described herein. Some embodiments may not include a visual display and may include other means for providing a user with information relating to operating characteristics of the electronic cigarette, for example using audio signaling or haptic feedback, or may not include any means for providing a user with information relating to operating characteristics of the electronic cigarette.

The control circuitry 20 is suitably configured/programmed to control the operation of the electronic cigarette to provide functionality in accordance with embodiments of the disclosure as described further herein, as well as for providing conventional operating functions of the electronic cigarette in line with the established techniques for controlling such devices. The control circuitry (processor circuitry) 20 may be considered to logically comprise various sub-units/circuitry elements associated with different aspects of the electronic cigarette's operation in accordance with the principles described herein and other conventional operating aspects of electronic cigarettes, such as display driving circuitry and user input detection. It will be appreciated the functionality of the control circuitry 20 can be provided in various different ways, for example using one or more suitably programmed programmable computer(s) and/or one or more suitably configured application-specific integrated circuit(s)/circuitry/chip(s)/chipset(s) configured to provide the desired functionality.

In this example the e-cigarette 1 comprises a user input button 14 and an pressure sensor 16. The control circuitry 20 may be configured to receive signaling from the pressure sensor 16 and to use this signaling to determine if a user is inhaling in the electronic cigarette and also to receive signaling from the input button 14 and to use this signaling to determine if a user is pressing (i.e. activating) the input button. These aspects of the operation of the electronic cigarette (i.e. puff detection and button press detection) may in themselves be performed in accordance with established techniques (for example using conventional inhalation sensor and inhalation sensor signal processing techniques and using conventional input button and input button signal processing techniques). Other example vapor provision systems may have only one of a user input button 14 and an pressure sensor 16. In further examples, a vapor provision system may have neither a user input button or an inhalation sensor depending on the configuration and operation of the system.

In accordance with embodiments of the disclosure, the cross-sectional area of the air path 52 at a location can be defined as the area of the plane perpendicular or transverse to a central or medial axis of the air path at that location. The area may be bound by at least one wall, for example, or other structural features. In use, the air flows in the direction of the central axis from the air inlet 28 towards the air outlet 50. Hence, the cross-sectional area provides a measure of the transverse area available for air to flow through during use.

As shown in FIG. 1, the air path 52 may have a first cross-sectional area A at a location in the vapor generating region 56 and a second cross-sectional area B at a location in the flavor insert region 54. The location of the second cross-sectional area B is downstream of the first cross-sectional area A in use. The second cross-sectional area B is at the location where the air path 52 enters the flavor insert region 54. When a flavor insert 8 is inserted or received into the flavor insert region 54, the second cross-sectional area B is at the location where the air path 52 is incident on the flavor insert 8.

In accordance with embodiments of the disclosure, the first cross-sectional area A is smaller than the second cross sectional area B. In some examples the first cross-sectional area A may, for example be between 20% and 80% smaller; e.g., between 30% and 70% smaller; e.g., between 40% and 60% smaller; e.g., approximately 50% smaller. In other words, first cross-sectional area is 20% to 80% of the size of the second cross-sectional area, preferably 30% and 70% of the size of the second cross-sectional area, more preferably between 40% and 60% of the size of the second cross-sectional area, and even more preferably approximately 50% of the size of the second cross-sectional area. As such, the cross-sectional area of the air path 52 expands or increases between the locations of the first cross-sectional area A and the second cross-sectional area B.

In some examples, the air path at the location of the first cross-sectional area A may have a circular shape, an elliptical shape, a polygonal shape or a rounded polygonal shape. Similarly, the air path at the location of the second cross-sectional area B may have a circular shape, an elliptical shape, a polygonal shape or a rounded polygonal shape. In some examples the air paths of the first cross-sectional area A and the second cross-sectional area B may have a shared shape (but with differing sizes), whilst in other examples the shape defining the cross-sectional areas may differ. By polygon it is meant any regular or irregular straight sided shape, for example any polygonal shape having between 3 and 10 sides, preferably between 4 and 6 sides. By rounded polygon it is meant a polygon as defined above, but with substantially rounded corners. In other examples, the first cross-sectional area and second-cross section (i.e. the air path defining them) may have a shape comprising combinations of linear and curved portions.

The first and second cross-sectional area (and the shape of that area) may be further defined in terms of dimensions (e.g. widths or lengths) corresponding to distances defining the extent of the shape defining the cross-sectional area. For example, the air path between the vapor generating region and the flavor imparting medium may be defined by a first and second dimension perpendicular to the air path or a medial axis of the air path. The change in cross-sectional area of the air path may be defined in terms of changes to the dimensions. As examples, the dimensions may correspond to the length of the sides of a rectangle or to the major and minor axis of an ellipse.

In some examples, the first dimension increases to a larger extent than the second dimension between the vapor generating region and the flavor imparting medium. In some of these examples, the second dimension may be unchanged or shared by the air path at the location of the first and second cross-sectional areas. In other words the first cross-sectional area A and the second cross-sectional area B may be said to have a corresponding or shared dimension (e.g. width or length). For example, both the first cross-sectional area A and the second cross-sectional area B may be rectangular, with the length of one side of the rectangle being unchanged, or the first cross-sectional area A and the second cross-sectional area B may be elliptical and the minor axis may not change between the two areas. In other words, the cross-sectional area of the air path may be said to change in only one dimension.

For some example e-cigarettes in accordance with the disclosure, the inner wall 58 (or walls) defining the air path 52 may be shaped to provide the change in cross-sectional area. In the example of FIG. 1, the air path 52 between the vapor generation region 56 and the flavor insert region 54 is defined or bound by an inner wall 58, which in general is a single continuous wall (e.g. a cylindrical wall or similar) but may be a configuration of a plurality of wall segments. In some examples, the inner wall 58 may extend beyond the vapor generation region, and/or the flavor insert region.

The channel formed by the inner wall 58 between the vapor generation region 56 and the flavor insert region 54 may be described as a funnel, expanding tube or hollow frustum; for example it may be described as having a frusto-conical or frusto-pyramidal shape between the first cross-sectional area A and second cross-sectional area B. The cross section of the air path 52 is increased between the first cross-sectional area A and second cross-sectional area B by altering the shape of the inner wall 58. For example, this may be achieved by increasing or expanding the separation between opposing portions of the inner wall 58 relative to the distance downstream (conversely, decreasing or contracting the separation between opposing portions relative to the distance upstream). In relation to FIG. 1, it will be appreciated that while the expansion in cross-sectional area appears to be in one dimension (i.e. across the page, as drawn), the expansion in cross-sectional area may be in both dimensions defining the plane perpendicular to the central or medial axis of the air path 52 (i.e. into the page as well as width across the page, as drawn).

Figure 2A:
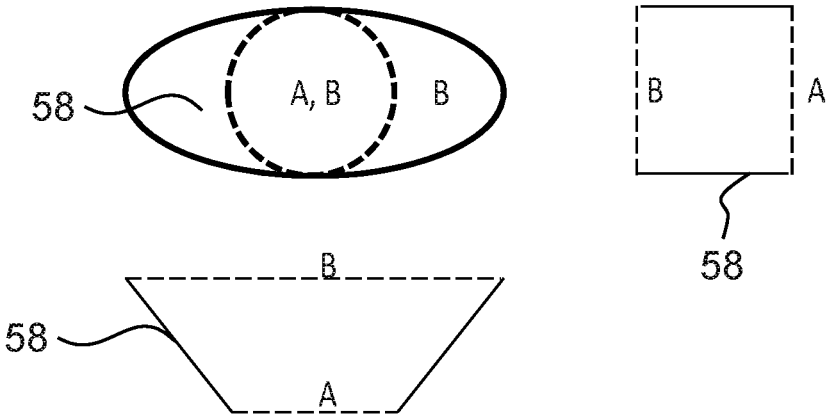
FIGS. 2A, 2B and 2C show comparisons of a first cross-sectional area A and a second cross-sectional area B through a vapor provision system in accordance with the example vapor provision system of FIG. 1.

FIG. 2A shows a comparison of the first cross-sectional area A and the second cross-sectional area B for an example e-cigarette in accordance with the embodiment of FIG. 1. The Figure shows a top-down view, a front view and a side view of the wall portion 58. In the example shown, the walls 58 of the air path 52 have the form a tube or frustum with a cross-sectional area which transitions from a circle to an elliptical shape. The top-down view of FIG. 2A shows that cross-sectional area A has a circular shape and cross-sectional area B has an elliptical cross section. The opposing walls of the air path 52 have moved apart (i.e. the separating distance has increased) in the dimension shown by the "front" view whilst remaining the same distance apart in the "side" view. As such the first dimension increases to a larger extent than the second dimension which is unchanged between the vapor generating region and the flavor imparting medium.

Figure 2B:
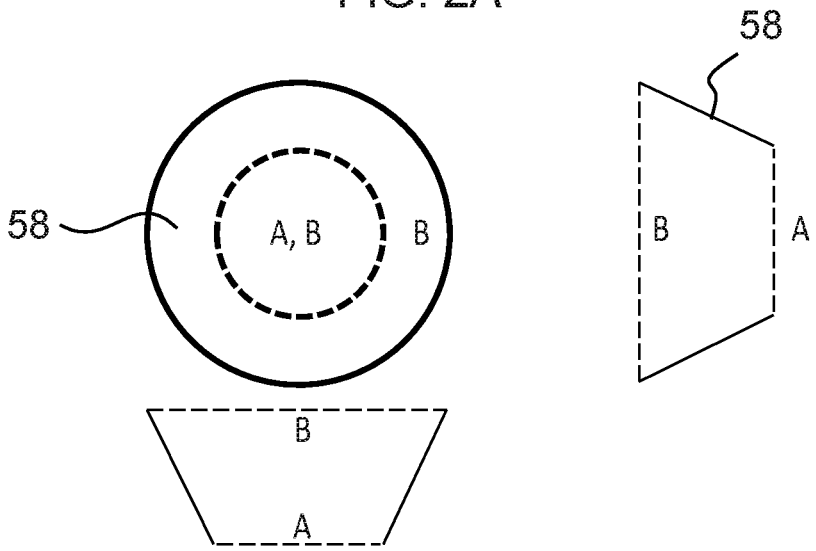

FIG. 2B shows a comparison of the first cross-sectional area A and the second cross-sectional area B for an example e-cigarette in accordance with the embodiment of FIG. 1. The Figure shows a top-down view, a front view and a side view of the wall portion 58. In the example shown, the walls 58 of the air path 52 have the form an expanding tube or frusto-conical shape with a circular cross-sectional area which becomes larger between A and B. The top-down view shows that both A and B have substantially circular cross-sections. The diameter of the circle has linearly increased between A and B as shown in the "front" and "side" views. As such the first dimension and the second dimension increase to the same extent between the vapor generating region and the flavor imparting medium.

Figure 2C:
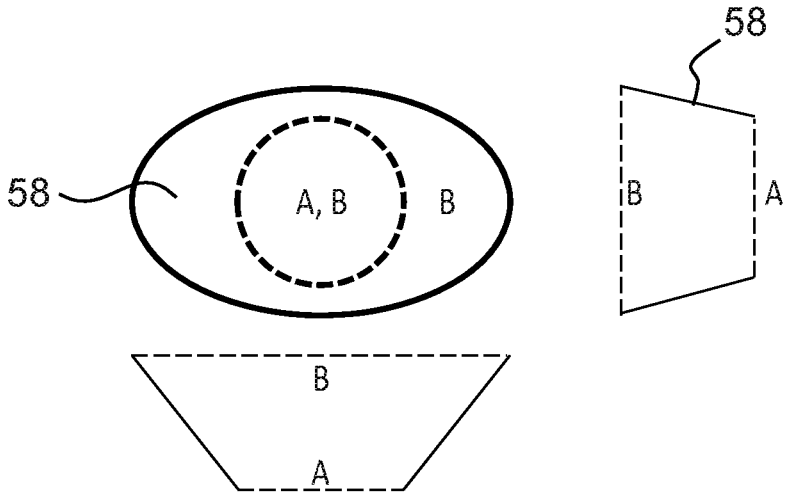

FIG. 2C shows a comparison of the first cross-sectional area A and the second cross-sectional area B for an example e-cigarette in accordance with the embodiment of FIG. 1. The Figure shows a top-down view, a front view and a side view of the wall portion 58. In the example shown, the walls 58 of the air path 52 have the form a tube or frustum with a cross-sectional area which transitions from a circle to an ellipse shape. The top-down view shows that A has a substantially circular cross-sectional area A and B has a substantially elliptical cross-section. The increase in separation of the walls of the funnel is shown to be greater in the direction corresponding to the front view than the side view. As such the first dimension increases to a larger extent than the second dimension between the vapor generating region and the flavor imparting medium.

In other examples, the walls 58 may be shaped to transition between the first cross-sectional area A and the second cross-sectional area B non-linearly. For example, the walls 58 may be shaped to have a concave or convex curvature, or to have a stepped profile.

Figure 3A:
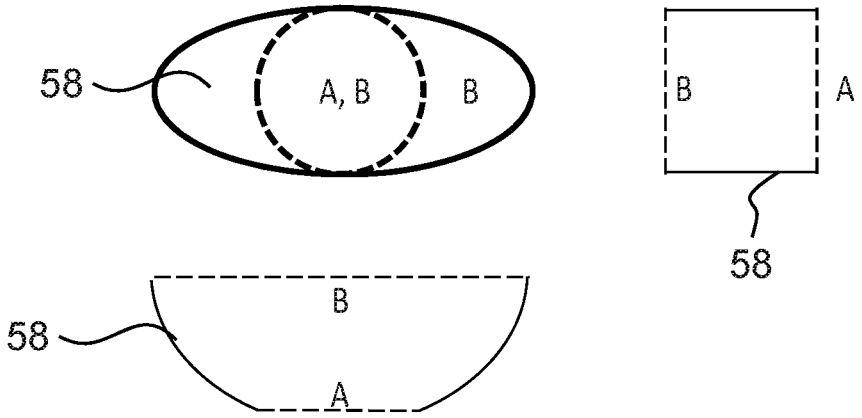
FIGS. 3A, 3B and 3C show further comparisons of a first cross-sectional area A and a second cross-sectional area B through a vapor provision system in accordance with certain embodiments of the disclosure.

FIG. 3A shows a comparison of the first cross-sectional area A and the second cross-sectional area B for an example e-cigarette in accordance with an embodiment of the disclosure. The Figure shows a top-down view, a front view and a side view of the wall portion 58. In the example shown, the walls 58 of the air path 52 have a concave shape with respect to the air path, and a cross-sectional area which transitions from circular to elliptical. In some examples the curvature of the inner wall 58 may be constant between the locations of A and B, while in other examples the curvature may change. As such the first dimension increases to a larger extent than the second dimension which is unchanged between the vapor generating region and the flavor imparting medium.

Figure 3B:
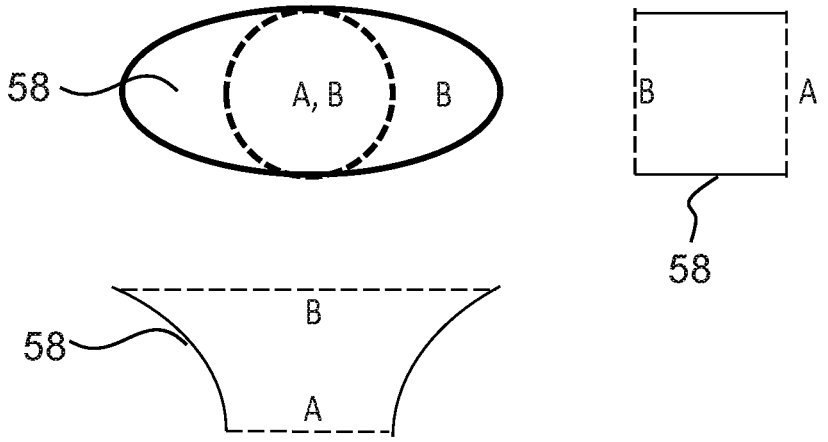

FIG. 3B shows a comparison of the first cross-sectional area A and the second cross-sectional area B for an example e-cigarette in accordance with embodiments of the disclosure. The Figure shows a top-down view, a front view and a side view of the wall portion 58. In the example shown, the walls 58 of the air path 52 have a convex shape with respect to the air path, and a cross-sectional area which transitions from circular to elliptical. As such the first dimension increases to a larger extent than the second dimension which is unchanged between the vapor generating region and the flavor imparting medium.

Figure 3C:
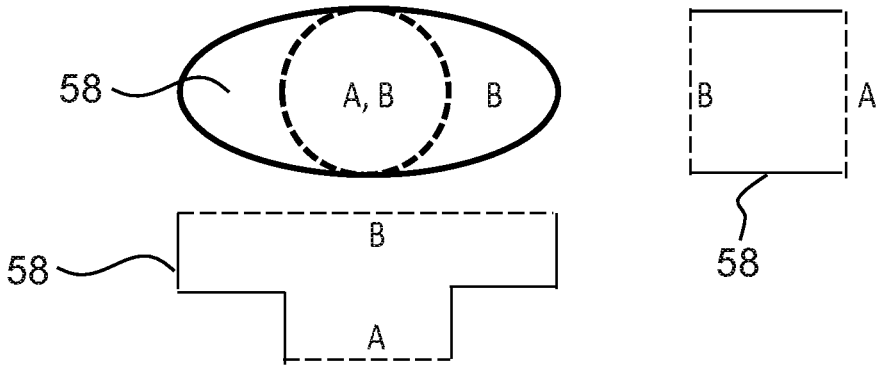

FIG. 3C shows a comparison of the first cross-sectional area A and the second cross-sectional area B for an example e-cigarette in accordance with embodiments of the disclosure. The Figure shows a top-down view, a front view and a side view of the wall portion 58. In the example shown, the walls 58 of the air path 52 have a stepped profile and a cross-sectional area which transitions from circular to elliptical. The step occurs substantially along one dimension such that a ledge is created at a location between the first and second cross-sections. In other examples there may be multiple steps; e.g. more than 2 steps; e.g. more than 5 steps; e.g. more than 8 steps. As such the first dimension increases to a larger extent than the second dimension which is unchanged between the vapor generating region and the flavor imparting medium.

Figure 4:
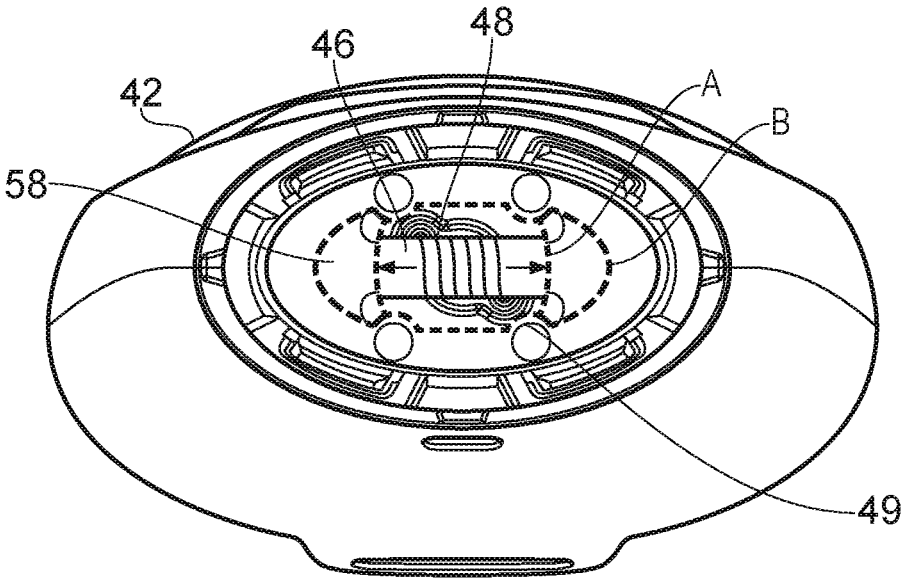
FIG. 4 represents in highly schematic cross-section, in the plane perpendicular to the airflow, a cartridge part for a vapor provision system in accordance with certain embodiments of the disclosure.

FIG. 4 is a cross-sectional view in the plane perpendicular to the air path through an example cartridge part 4 in accordance with certain embodiments of the disclosure. FIG. 4 shows a housing 42 of the cartridge part 4 having a central cavity (i.e. the air path and flavor insert region defined by the inner wall 58) in which a wick 46 and heater (vaporizer) 48 can be seen. Marked by a dashed red line is an outline of a first cross-sectional area A. Broadly speaking, the first cross-sectional area A encompasses the cross-sectional area of the air path 52 in the region surrounding the wick 46 and heater 48. Marked by a dashed black line is an outline of a second cross-sectional area B. Broadly speaking, the second cross-sectional area B encompasses the cross-sectional area of the air path at the region where the air path first encounters the flavor insert. The second cross-sectional area B is shown to be larger than the first cross-sectional area A. The first cross-sectional area has a substantially circular shape while the second cross-sectional area has a substantially elliptical shape. The shape of the second cross-sectional area is expanded (or otherwise changed) with respect to the shape of the first cross-sectional area. One dimension, defining the shapes of the first and second cross-sectional areas, is increases to a larger extent than the other dimension.

Figure 5:
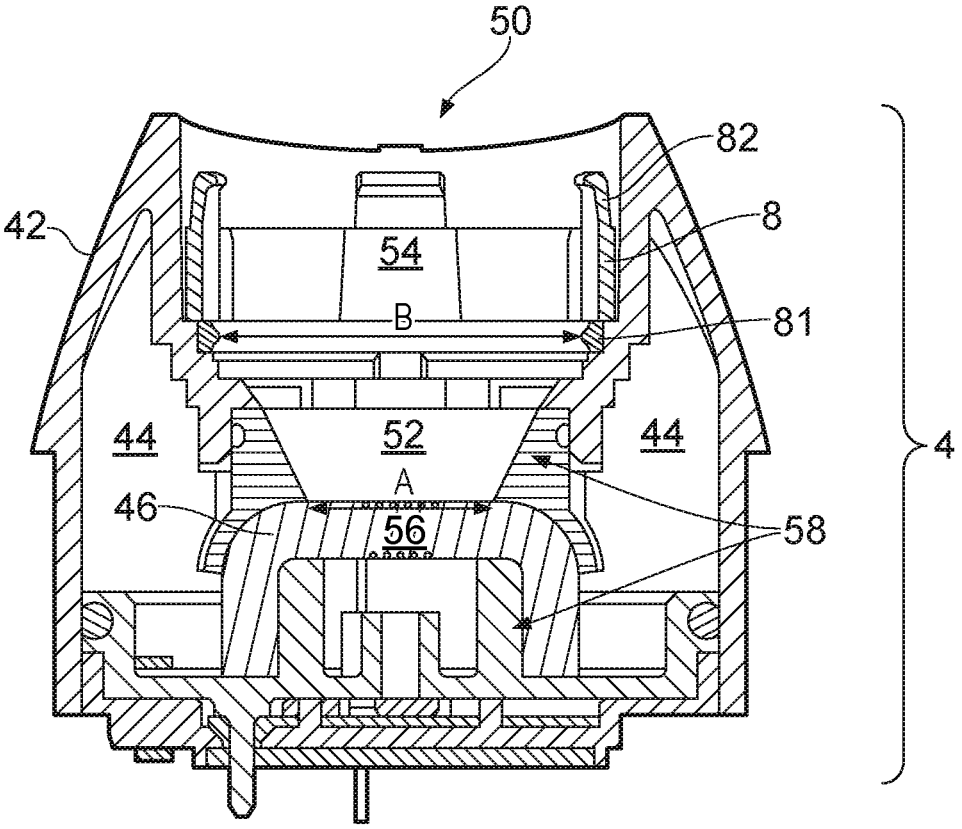
FIG. 5 represents in highly schematic cross-sectional area A cartridge part for a vapor provision system in accordance with certain embodiments of the disclosure.

The example of FIG. 5 further shows that the inner wall 58 may comprises ledges, lips, or similar 49 which may be act to retain components of the cartridge part 4 together and/or aid the positioning of the flavor insert 8 (for example, by preventing over-insertion into the air path). These ledges 49 may alter the shape of the wall but do not substantially disrupt the overall configuration (i.e. the circular or elliptical cross-sectional shape).

In other examples, inner wall 58 may be shaped to include combinations of linear portions, curved portions and stepped portions in one or more dimensions. In some examples, the inner wall 58 is shaped in a manner which ensures that the cross-sectional area of the air path 52 between the vapor generation region 56 and the flavor insert region 54 monotonically increases.

In accordance with embodiments of the disclosure, the shaping of the air path 52 or walls may encourage the air to disperse, spread out or become less dense to distribute vapor over the expanded air path (i.e. due to the increased size of the cross-section) which allows the vapor carrying air flow to be incident on a greater surface area of the tobacco material. As a result, the vapor can firstly be provided more evenly over a large surface of the flavor insert 8. This may allow the vapor to more effectively infiltrate or otherwise interact with a larger portion or bulk of the flavor insert 8, instead of the vapor being provided to a concentrated (central) region of the flavor insert which is aligned with the vapor generating region (i.e. aligned with the cross-sectional area A corresponding to the vapor generating region). Additionally, the shaping causes the vapor to be provided as a less dense flow downstream of the vapor generating region. In other words, during a puff the air passing the first cross-sectional area A may have a higher air density than air passing through the second cross-sectional area B. This will reduce the level of vapor incident per unit of area, whilst not significantly effecting the overall level of vapor provided to the flavor insert.

By applying the vapor to a larger surface area (and at a lower density), oversaturation of the particular portions of the flavorant is reduced or prevented. Saturation of the flavorant occurs when vapor condenses on the surface of the flavorant. Saturation is believed to preventing or inhibiting the entrainment of flavors onto passing vapor by forming a barrier or shell on the surface of the flavorant. As such, saturation is considered to potentially cause a reduction in the life of the flavor insert due to a reduction in the entrainment rate of flavor from the flavorant. Furthermore, it is further believed that oversaturation may lead to the release of liquid (i.e. leakage) from the outlet 50 of the device. The inhalation of such liquids is an undesirable experience for most users.

FIG. 5 is a cross-sectional view through an example cartridge part 4 in accordance with certain embodiments of the disclosure. The cartridge part 4 comprises a cartridge housing 42 which forms an external wall to a reservoir 44 that contains liquid vapor precursor material. The liquid vapor precursor material may be conventional, and may be referred to as e-liquid. The liquid reservoir 44 in this example has an annular shape with an outer wall defined by the cartridge housing 42 and an inner wall 58 that defines an air path 52 through the cartridge part 4. As shown, the inner wall 58 may be formed of more than one component, with the different components joining together to define a single air path. Furthermore, as shown, the inner wall 58 may be formed in part by the same component as the cartridge housing 42.

The cartridge part further comprises a wick 46 and a heater or vaporizer (not shown) located towards an end of the reservoir 44 opposite to the mouthpiece outlet 50. In this example the wick 46 extends transversely across the cartridge air path 52 with its ends extending into the reservoir 44 of e-liquid through openings in the inner wall 58 of the reservoir 44. As shown, the openings may be formed at a join between a first component of the inner wall 58 and a second component of the inner wall. The openings in the inner wall of the reservoir are sized to broadly match the dimensions of the wick 46 to provide a reasonable seal against leakage from the liquid reservoir into the cartridge air path without unduly compressing the wick, which may be detrimental to its fluid transfer performance.

The inner wall 58 of the air path 52 between the vapor generating region 56 and the flavor insert region 54, is shown to increase linearly in width over a first portion (adjacent to the vapor generating region) and to then have a small step change in a second portion (adjacent to the flavor insert region). Adjacent to this second portion is an inlet 81 of a cartridge or pod housing 82 for containing a flavor insert 8.

The example of FIG. 5 depicts only a lower portion of the pod housing 82 which may be used to contain a flavor insert 8 (i.e. a tobacco substance or flavorant). Vapor entering via the air inlet 81 interacts with the flavor insert 8. The pod housing 82 containing the flavor insert 8 is inserted into the air path 52 such that the air inlet 81 is orientated to provide a surface perpendicular to the air path from the vapor generation region 56. While not shown, in some examples the pod housing 82 may comprise an upper portion which additionally defines the outlet 50 of the e-cigarette 1. For example the pod housing 82 may be configured to protrude from the inner wall 58 of the air path 52 to provide a mouthpiece for the e-cigarette 1. In some examples the pod housing 82 may not be retained within the air path 52 but instead may be clipped or otherwise retained against the e-cigarette such that the outlet 50 of the e-cigarette aligns with the inlet 81 of the pod. In other examples the pod 82 may be retained substantially within the walls of the air path 52. In some examples a further mouthpiece may be placed over the downstream end of the pod 82 to form the outlet 50 of the e-cigarette 1.

In some examples the flavor insert 8 comprises a mesh covering the inlet 81. Meshes of these examples may allow vapor to infiltrate the flavor insert 8 but retain flavorant (for example, loose tobacco or tobacco granules) within the pod 82. Example meshes may, for example, have a grating separation/pitch of between 0.2 and 2 mm with holes making up around half the surface area of the mesh, for example with a mesh pitch of around 0.6 mm comprising 0.4 mm openings separated by 0.2 mm of material forming the mesh.

This has been found to be an appropriate example for allowing suitable airflow through the mesh while suitably retaining the flavorant.

Some example cartridges may comprise a plurality of inlets; for example two or more inlets. Multiple inlets may be utilized to provide vapor to the flavorant over a wider area. In some examples the plurality of inlets may comprise three or more inlets, and preferably five or more inlets. In some examples the plurality of inlets may be arranged in a regular pattern, for example, to have one or more forms of symmetry with respect to a center point and/or be distributed evenly across a surface. In some examples, at least one of the plurality of inlets may be covered by a mesh.

Additionally, some example cartridges may include mesh features covering one or more outlets. Meshes for outlets may have substantially similar designs to those for covering any inlets, such as inlet 81.

While the above-described embodiments have in some respects focused on some specific example vapor provision systems, it will be appreciated the same principles can be applied for vapor provision systems using other technologies. That is to say, the specific manner in which various aspects of the vapor provision system function are not directly relevant to the principles underlying the examples described herein.

For example, whereas the above-described embodiments have primarily focused on devices having an electrical heater based vaporizer for heating a liquid vapor precursor material, the same principles may be adopted in accordance with vaporizers based on other technologies, for example piezoelectric vibrator based vaporizers or optical heating vaporizers, and also devices based on other aerosol precursor materials, for example solid materials, such as plant derived materials, such as tobacco derivative materials, or other forms of vapor precursor materials, such as gel, paste or foam based vapor precursor materials.

Furthermore, and as already noted, it will be appreciated the above-described approaches for providing multiple independent activation mechanisms for vapor generation in an electronic cigarette may be implemented in cigarettes having a different overall construction that represented in FIG. 1. For example, the same principles may be adopted in an electronic cigarette which does not comprise a two-part modular construction, but which instead comprises a single-part device, for example a disposable (i.e. non-rechargeable and non-refillable) device. Furthermore, in some implementations of a modular device, the arrangement of components may be different. For example, in some implementations the control unit may also comprise the vaporizer with a replaceable cartridge providing a source of vapor precursor material for the vaporizer to use to generate vapor.

Thus there has been described an aerosol provision system comprising an air path extending from a vapor generating region in which vapor is generated for user inhalation to a flavor imparting region for receiving a flavor imparting medium for imparting a flavor to the vapor; wherein a first cross-sectional area of the air path in the vapor generating region is smaller than a second cross-sectional area of the air path that enters a flavor imparting medium received in the flavor imparting region In order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention (s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other inventions not presently claimed, but which may be claimed in future.

The invention claimed is:

1. An aerosol provision system comprising an air path extending from a vapor generating region in which vapor is generated for user inhalation to a flavor imparting region for receiving a flavor imparting medium for imparting a flavor to the vapor;

wherein a first cross-sectional area of the air path in the vapor generating region is smaller than a second cross-sectional area of the air path where the air path enters the flavor imparting region, and wherein an extent of the air path in a first direction perpendicular to the air path increases from the vapor generating region to the flavor imparting region by more than an extent of the air path in a second direction perpendicular to the air path.

2. The aerosol provision system of claim 1, wherein the ratio of the first cross-sectional area to the second cross-sectional area is in a range selected from the group consisting of: 0.2 to 0.8; 0.3 to 0.7; and 0.4 to 0.6.

3. The aerosol provision system of claim 1, wherein the extent of the air path in the second direction is substantially the same in the vapor generating region and the flavor imparting region.

4. The aerosol provision system of claim 1, wherein the air path in the vapor generating region has a cross-sectional shape selected from the group consisting of: a circular shape; an elliptical shape; a polygonal shape; and a rounded polygonal shape.

5. The aerosol provision system of claim 1, wherein the air path entering the flavor imparting medium has a cross-sectional shape selected from the group consisting of: a circular shape; an elliptical shape; a polygonal shape; and a rounded polygonal shape.

6. The aerosol provision system of claim 1, wherein the air path increases monotonically between the first cross-sectional area and the second cross-sectional area.

7. The aerosol provision system of claim 1, wherein the air path includes a step-wise increase from the first cross-sectional area to the second cross-sectional area at a location between the vapor generating region and the flavor imparting region.

8. The aerosol provision system of claim 1, wherein the aerosol provision system further comprises the flavor imparting medium.

9. The aerosol provision system of claim 8, wherein the flavor imparting medium is contained in a removable cartridge for the aerosol provision system.

10. The aerosol provision system of claim 9, wherein the removable cartridge comprises an inlet end with a mesh covering the inlet end.

11. The aerosol provision system of claim 1, wherein the flavor imparting medium comprises a tobacco.

12. The aerosol provision system of claim 1, further comprising a vaporizer for generating vapor in the vapor generating region.

13. An aerosol provision means comprising air path means extending from a vapor generating region in which vapor is generated for user inhalation to a flavor imparting region for receiving a flavor imparting means for imparting a flavor to the vapor;

wherein a first cross-sectional area of the air path means in the vapor generating region is smaller than a second cross-sectional area of the air path means where it enters the flavor imparting region, and wherein an extent of the air path in a first direction perpendicular to the air path increases from the vapor generating region to the flavor imparting region by more than an extent of the air path in a second direction perpendicular to the air path.

14. A cartridge for an aerosol provision system, the cartridge comprising an air path extending from a vapor generating region in which vapor is generated for user inhalation to a flavor imparting region for receiving a flavor imparting medium for imparting a flavor to the vapor;

wherein a first cross-sectional area of the air path in the vapor generating region is smaller than a second cross-sectional area of the air path where it enters the flavor imparting region, and wherein an extent of the air path in a first direction perpendicular to the air path increases from the vapor generating region to the flavor imparting region by more than an extent of the air path in a second direction perpendicular to the air path.

* * * * *